United States Patent [19]

D'Orsi et al.

[11] Patent Number: 5,067,502

[45] Date of Patent: Nov. 26, 1991

[54] HAIR TRIMMING GUIDE HAVING AN ADJUSTABLE COMB

[76] Inventors: Anthony D'Orsi, 2322 62 St., Brooklyn, N.Y. 11204; George Spector, 233 Broadway RM 3815, New York, N.Y. 10007

[21] Appl. No.: 658,332

[22] Filed: Feb. 20, 1991

[51] Int. Cl.[5] ..... A45D 24/34

[52] U.S. Cl. ..... 132/213.1; 132/214

[58] Field of Search ..... 132/213, 213.1, 214, 132/129, 131

[56] References Cited

U.S. PATENT DOCUMENTS

| | | | |
|---|---|---|---|
| 181,904 | 9/1876 | Bow et al. | 132/213 X |
| 3,638,665 | 2/1972 | Staffas, Sr. | 132/213.1 X |
| 3,848,611 | 11/1974 | Asaro | 132/213.1 |

FOREIGN PATENT DOCUMENTS

| | | | |
|---|---|---|---|
| 0654477 | 11/1928 | France | 132/129 |
| 2416668 | 10/1979 | France | 132/214 |
| 2538689 | 7/1984 | France | 132/214 |

*Primary Examiner*—John J. Wilson
*Assistant Examiner*—Jeffrey A. Smith

[57] ABSTRACT

A hair trimming guide implement is provided and consists of a handle adapted to be grasped by a hand of a person, a Y-shaped shank having a pair of arms extending from one end of the handle, and two combs. Each comb extends from respective arms of the Y-shaped shank on the handle in a spaced apart relationship. One comb can bear against the scalp while excess hair extending through the other comb can be trimmed off the head of another person with a scissors. One comb is adjustable angularly and/or translationally relative to the other comb.

3 Claims, 1 Drawing Sheet

HAIR TRIMMING GUIDE HAVING AN ADJUSTABLE COMB

BACKGROUND OF THE INVENTION

The instant invention relates generally to combs and more specifically it relates to a hair trimming guide implement which provides a pair of spaced apart combs on a handle used to aid a person in trimming off excess hair.

There are available various conventional combs which do not provide the novel improvements of the invention herein disclosed.

SUMMARY OF THE INVENTION

A primary object of the present invention is to provide a hair trimming guide implement that will overcome the shortcomings of the prior art devices.

Another object is to provide a hair trimming guide implement that includes a pair of spaced apart combs on a handle used to aid a person in trimming off excess hair from a head of a person with a scissors.

An additional object is to provide hair trimming guide implement in which one of the combs is adjustable with respect to the other combs which is stationary to the handle so that it can accommodate various hair lengths when used as a guide in trimming hair.

A further object is to provide hair trimming guide implement that is simple and easy to use.

A still further object is to provide a hair trimming guide implement that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
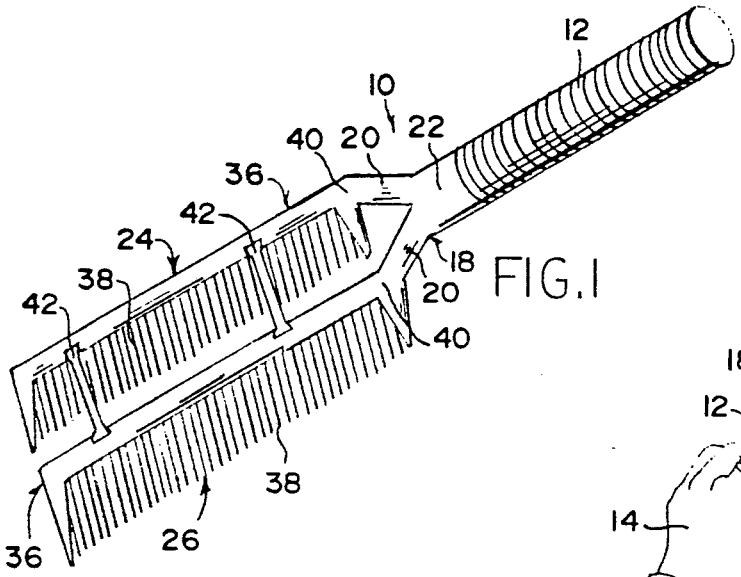
FIG. 1 is a perspective view of the instant invention.
Figure 2:
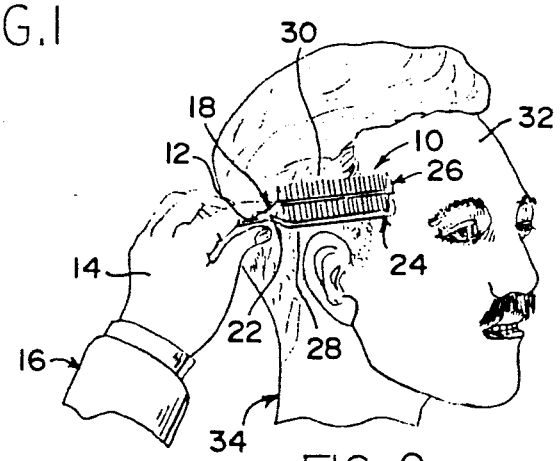
FIG. 2 is a perspective view showing the manner in which the invention is applied as a guide in trimming hair.

Turning now descriptively to the drawings, in which similar reference characters denote similar elements throughout the several views, the Figures illustrate a hair trimming guide implement consisting of a handle 12 adapted to be grasped by a hand 14 of a person 16. A Y-shaped shank 18 having a pair of arms 20 extends from one end 22 of the handle 12. Two combs 24, 26 are provided with each extending from one of the arms 20 of the Y-shaped shank 18 on the handle 12 in a spaced apart relationship. One of the combs 24 can bear against the scalp 28 while excess hair 30 extending through the other combs 26 can be trimmed off the head 32 of another person 34 with a scissors, not shown.

Figure 3:
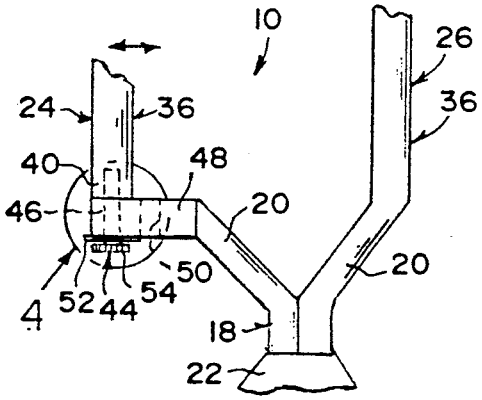
FIG. 3 is a top view of a portion of a modification showing one of the combs being adjustable with respect to the handle.
Figure 4:
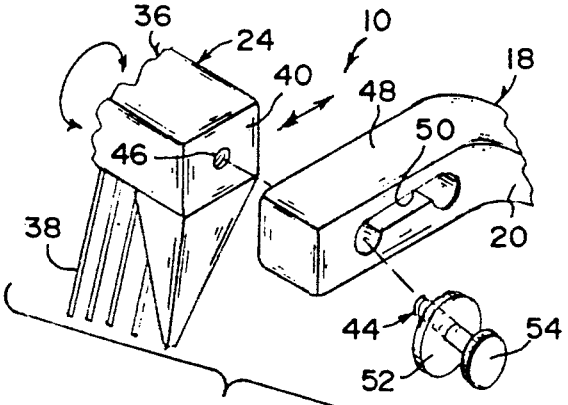
FIG. 4 is an exploded perspective view as indicated by arrow 4 in FIG. 3 showing the adjusting structure therein.

Each of the combs 24, 26 includes a substantially flat spine 36 having a plurality of teeth 38 projecting therefrom, whereby one end 40 of said spine is connected to one arm 20 of the Y-shaped shank 18 on the handle 12. At least one stabilizer bar 42 extends transversely between two of the spines 36 of the two combs 24, 26 to prevent the combs from flexing relative to each other.

modification is shown in FIGS. 3 and 4 that includes a mechanism 44 for adjusting the angle and distance of the first comb 24 with respect to the second comb 26 so that the implement 10 can accommodate various hair lengths 30 when used as a guide in trimming hair.

The adjusting mechanism 44 includes the first comb 24 having a threaded aperture 46 in the end 40 of the spine 36. An extension member 48 is on one of the arms 20 of the Y-shaped shank 18 and has an elongated slot 50. A washer 52 is to be placed against the extension member 48 at the elongated slot 50, while a bolt 54 extends through the washer 52, the elongated slot 50 and into the threaded aperture 46 in the spine 36 so that the angle of the first comb and transverse distance to the second comb 26 can be adjusted and retained by tightening the bolt 54 be made irrespective and independantly of the angular adjustment of the teeth discussed above.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A hair trimming guide implement which comprises:

a) a handle adapted to be grasped by a hand of a person;

b) a Y-shaped shank having a pair of spaced arms extending from one end of said handle; and c) two combs one of each said combs extending from one of each of said arms of said Y-shaped shank on said handle in a spaced apart relationship so that one of said combs can bear against the scalp while excess hair extending through the other of said combs can be trimmed off the head of another person with a scissors, wherein each of said combs includes a spine having a set of teeth projecting therefrom, whereby one end of each said spine is connected to one of said arms said hair trimming guide implement, further including means for adjusting individually the angle between said sets of teeth and the transverse space between said spines so that said implement can accomodate various hair lengths and hair thickness when used as a guide in trimming hair.

2. A hair trimming guide implement as recited in claim 1, wherein said adjusting means includes:

a) said first comb having a threaded aperture in said one end of said spine;

b) an extension member on one of said arms of said Y-shaped shank and having an elongated slot;

c) a washer to be placed against said extension member at said elongated slot; and d) a bolt to extend through said washer, the elongated slot and into said threaded aperture in said spine so that the angle of said first comb and distance to said second comb can be adjusted and retained by tightening said bolt.

3. A hair trimming guide implement as recited in claim 1, wherein said adjusting comprises a connection between one of said arms and one of said spines whereby said one of said spines can be moved transversely relative the other of said spines and whereby said one of said spines can be rotated relative said other of said spines independantly of the transverse movement.

* * * * *